United States Patent [19]

Kafkis et al.

[11] Patent Number: 4,974,984

[45] Date of Patent: Dec. 4, 1990

[54] BRUSH TOP/DISPENSER CONTAINER

[75] Inventors: N. H. Kafkis, Skokie; George J. Kafkis, Chicago; Bob N. Kafkis, Winnetka, all of Ill.

[73] Assignee: Kafko International, Ltd., Chicago, Ill.

[21] Appl. No.: 330,441

[22] Filed: Mar. 7, 1989

Related U.S. Application Data

[63] Continuation of Ser. No. 88,085, Aug. 21, 1987, abandoned.

[51] Int. Cl.[5] ..... A46B 11/00

[52] U.S. Cl. ..... 401/268; 401/186; 401/269; 401/281; 401/288

[58] Field of Search ..... 401/281, 288, 285, 286, 401/290, 190, 183, 186, 269, 262; 222/451

[56] References Cited

U.S. PATENT DOCUMENTS

| | | | |
|---|---|---|---|
| 1,335,896 | 4/1920 | Hyde | 401/288 |
| 2,005,762 | 6/1935 | Weissflog | 401/288 |
| 2,283,765 | 5/1942 | Rubin | 401/290 X |
| 2,292,939 | 8/1942 | Hollenbeck | 401/288 |
| 2,505,441 | 4/1950 | Taverner | 15/135 |
| 2,718,023 | 9/1955 | Douglass, Jr. | 401/186 |
| 2,825,080 | 3/1958 | Bongiovanni | 15/131.1 |
| 2,827,650 | 3/1958 | Morrill et al. | 401/186 |
| 3,307,908 | 2/1968 | Cupp | 401/190 |
| 3,458,263 | 7/1969 | Gibbs | 401/290 X |
| 3,485,563 | 12/1969 | Chennell | 401/183 |
| 3,774,822 | 11/1973 | Hazard | 222/541 |
| 3,981,597 | 9/1976 | Cohn | 401/190 |
| 4,066,367 | 1/1978 | Sherosky | 401/290 |
| 4,081,108 | 3/1978 | Wilson et al. | 222/541 X |
| 4,143,667 | 3/1979 | Peilet | 401/28 |
| 4,199,270 | 4/1980 | Tomasini | 401/286 X |
| 4,222,696 | 9/1980 | Roth | 401/183 X |
| 4,279,527 | 7/1981 | Moe et al. | 401/277 |
| 4,553,871 | 11/1985 | Niles | 401/281 X |
| 4,752,015 | 6/1988 | Schumacher | 401/269 X |

FOREIGN PATENT DOCUMENTS

| | | | |
|---|---|---|---|
| 250133 | 10/1966 | Austria | 401/183 |
| 2107488 | 8/1972 | Fed. Rep. of Germany | 401/183 |
| 1243684 | 9/1960 | France | 401/183 |
| 1537841 | 8/1968 | France | 401/288 |
| 345868 | 6/1960 | Switzerland | 401/183 |
| 944420 | 12/1963 | United Kingdom | 401/183 |
| 2012575 | 8/1979 | United Kingdom | 401/286 |

*Primary Examiner*—Steven A. Bratlie
*Attorney, Agent, or Firm*—Timothy T. Patula

[57] ABSTRACT

A fluid dispensing container with brush type applicator. The container having an annular flange formed thereon. An applicator/brush is detachably coupled to the container by mating with the annular flange of the container. The applicator/brush has at least one opening thereto. A dispensing cap with at least one opening is affixed to at least one opening of the container in fluid communication therewith and positioned internal to the applicator/brush, so that when the dispensing cap is opened, the fluid may pass from at least one opening of the container through the dispensing cap and at least one opening in the applicator/brush.

6 Claims, 2 Drawing Sheets

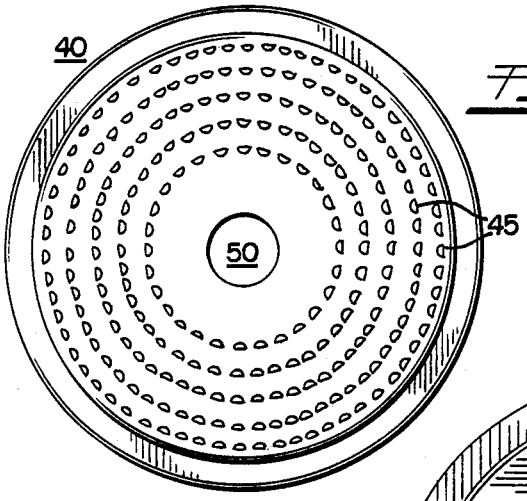
FIG. 4
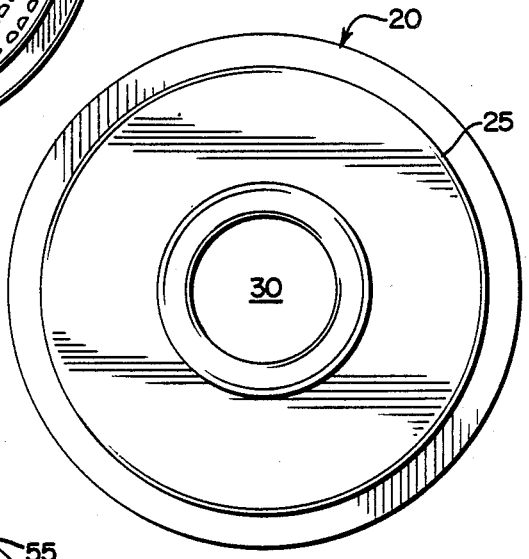
FIG. 6
FIG. 5
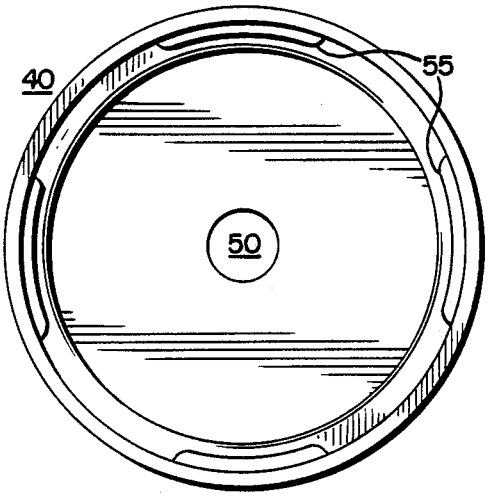
FIG. 7
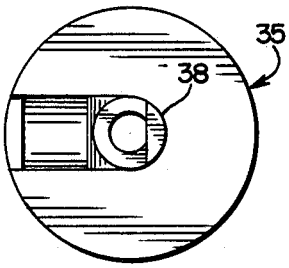

BRUSH TOP/DISPENSER CONTAINER

This is a continuation of application Ser. No. 088,085, filed on Aug. 21, 1987, now abandoned.

This invention relates generally to a substance dispensing container with applicator. More particularly, the invention relates to a liquid dispensor having a brush type applicator formed as an overcap.

BACKGROUND OF THE INVENTION & SUMMARY

Containers for dispensing liquids having an applicator or brush means associated therewith as shown in U.S. Pat. No. 4,279,527 were complicated and expensive devices which often failed or became "gummed-up" and increased the overall cost of product packaging because of their complexity and numerous components. Other devices, such as that shown in U.S. Pat. No. 3,485,563, disclose complex attachment means to containers or as shown in U.S. Pat. No. 4,143,667, brushes which are retractable Other inventions required a tube or other means to be inserted into the container in order to operate as a fountain type fluid dispensor/applicator as that shown in U.S. Pat. No. 3,485,563. Many devices, such as shown in U.S. Pat. No 2,505,411 were difficult to ready for use and to be stored after use. Still others did not provide an apPlicator or were suitable for vigorous scrubbing applications.

The present invention overcomes the problem of the prior known dispensing container/applicators by providing an annular groove in the shoulder of a container to which a brush top overcap is detachably coupled. An opening is formed in the overcap. A closable dispensing cap is affixed to the opening of the container, which when opened, is in fluid with the opening in the overcap. The invention allows the container to dispense its contents through the brush top cap while vigorously brushing the applied surface.

One object of the present invention is to provide a simple inexpensive container to dispense substances to be applied by an applicator or brush means. After use, the container is readily closed for storage and eventual re-use.

A further object is to provide a container and dispensing applicator with a brushing means, in which the container provides a good grip or handle for vigorous brushing while continuing to dispense the contained substance.

A further object is to provide a container and dispensing applicator with brushing means that will perform readily with many different types of closures such as a nozzle, push/pull, puncture, puncture/plug or others.

Another object of the invention is to provide by blow molding or other means an annular groove or "chime" in the shoulder of the container which aggressively mates with the brush top overcap which will remain coupled to the container while enduring substantial stresses caused by forceful brushing.

Yet another object of the invention is to provide for a compressible or deformable container which may be squeezed by the user in order to control or promote the amount of substance released in proximity to the brushing means.

The invention involved in this application is one which is not difficult to produce, is inexpensive and is so made that under normal use conditions it will be long lasting.

Further objects, advantages and features of the present invention will appear from the following description, claims, and accompanying drawings, in which like reference numerals designate like parts.

BRIEF DESCRIPTION OF THE DRAWINGS

A further understanding of the foregoing may be had by reference to the accompanying drawings, wherein:

FIG. 4 is a top plan view of the brush top overcap of the dispensing container of FIG. 2;

FIG. 5 is a bottom plan view of the brush top overcap of the dispensing container of FIG. 2;

FIG. 6 is a view of the container taken along line 6—6 of FIG. 2; and FIG. 7 is a top plan view of the dispensing cap shown in FIG. 2.

DETAILED DESCRIPTION OF THE PREFERRED EMBODIMENT

Figure 1:
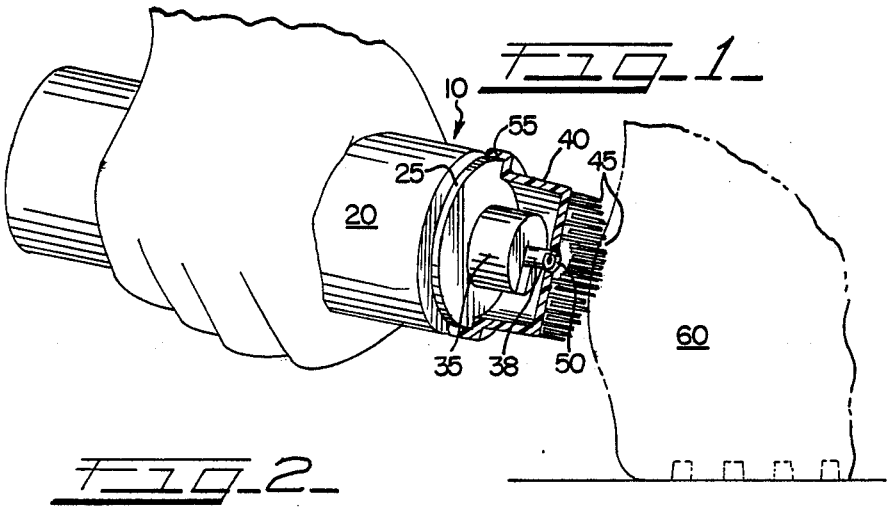
FIG. 1 is perspective and partial cut-away view of the substance dispensing container with brush-type applicator being used on the side wall of a vehicle tire.

Referring now to the drawings and particularly to FIG. 6 there is shown a top plan view of container 20 with an annular flange 25 positioned about the shoulder of container opening 30. The annular flange 25 may be blow molded of plastic or other material or formed by some other means or materials. Container 20 may be of any type, including deformable or squeeze type bottles. A closeable dispensing cap 35 is shown in the top plan view of in FIG. 7 as a nozzle type closure 38. It is understood, that the present invention is intended to include other types of dispensing caps including, but not limited to, push/pull, puncture or puncture/ plug type. Dispensing cap 35 may be affixed to container opening 30 by threads (not shown) or other means.

Brush top overcap 40 is depicted in FIG. 4 with an applicator or bristle type brush 45 positioned thereon. It is understood that the present invention is intended to include other types of applicator means to include but not limited to wire brushes or pads.

An opening 50 is formed between the interior and exterior of the overcap 40. An internal view of the generally hollow overcap 40 is shown in FIG. 5. Opening 50 is also depicted therein. It is understood that the present invention is intended to include at least one opening between the interior and exterior of the overcap 40. Lugs 55, located adjacent the bottom edge of overcap 40 and projecting inwardly from the inner surface of overcap 40, are positioned to detachably couple the overcap 40 to the container 20 by engagement with annular flange 25.

Figure 2:
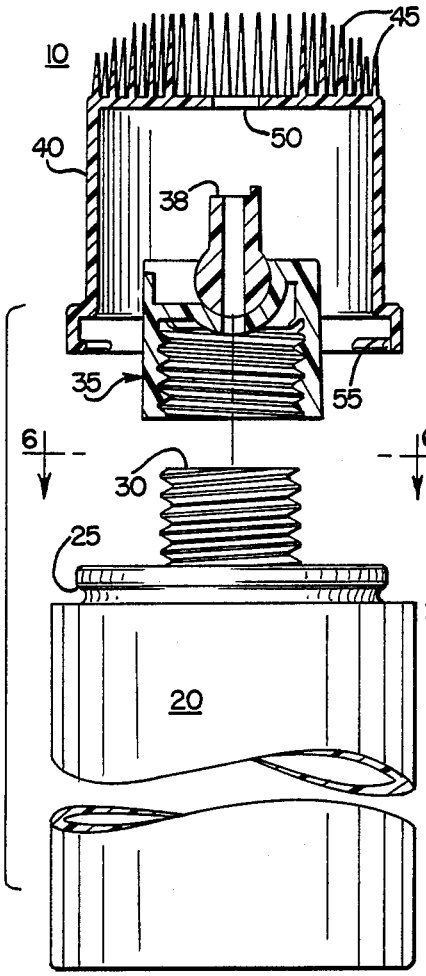
FIG. 2 is an exploded view of the dispensing container of the present invention.

Shown in FIG. 2 is an exploded view of the present invention referred to generally by the numeral 10. Nozzle 38 of dispensing cap 35 is shown in its "open" or upright position.

Figure 3:
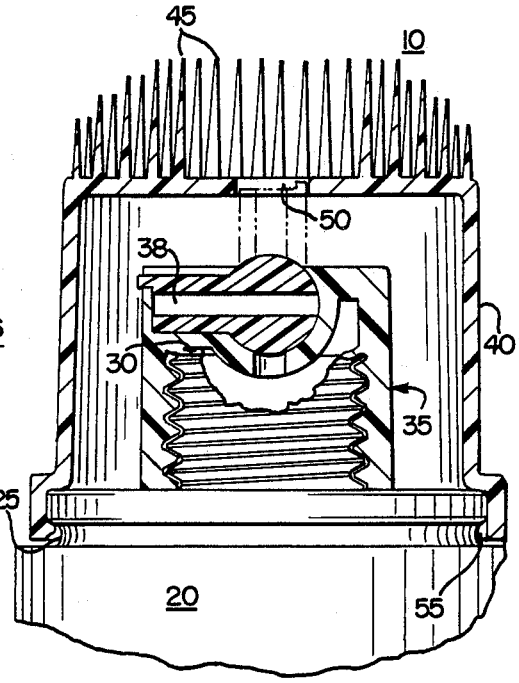
FIG. 3 is a partial elevational cross-sectional view of the dispensing container of FIG. 2.

FIG. 3 depicts the present invention 10 in its storage or non-use state with nozzle 38 closed or in its downward position on dispensing cap 35, preventing substance passage from container 20 through opening 30. Brushtop overcap 40 is coupled to container 20 by the mating of overcap lugs 55 and annular flange 25.

The operation of the preferred embodiment of the dispensing container with applicator 10 is simply and effectively described as follows. Overcap 40 and substance containing container 20 are individually grasped and uncoupled by overcoming the resistance between annular flange 25 on container 20 and overcap lugs 55 on overcap 40. Nozzle closure 38 is then positioned in its upright or "open" position as shown in FIG. 2. Overcap 40 is replaced on container 20 recoupling lugs 25 and flange 55. Nozzle 38 may protrude slightly through opening 50 in overcap 40. The contents may now pass from container 20 by container opening 30 through closure dispensing cap 35 by nozzle 38 and through overcap opening 50 so as to be in physical proximity and contact with brush 45. The container 20 may be firmly grasped as shown in FIG. 1, so that the contents of container 20 may be vigorously brushed or applied to the desired surface. As shown in FIG. 1 the contents may be applied to the side of a whitewall tire 60 or any other application where it is advantageous to apply a substance with an applicator or brush means.

Additionally, container 20 may be deformable or squeezable so as to accelerate or control the flow of the substance from the container. Container 20 may also be formed integrally with the dispensing cap 35 or other type of closable dispensing cap.

While one form of the invention has been described, it will be understood that the invention may be utilized in other forms and environments, so that the purpose of the appended claims is to cover all such forms of devices not disclosed but which embody the invention disclosed herein.

What we claim is:

1. A non-aerosol fluid dispenser with a brush-type applicator, said dispenser comprising:

a blow-molded container having a first and second end located at opposite ends of a longitudinal axis, with at least one opening in said first end, said container having a blow-molded annular chime surrounding said opening at said first end;

cap means, coupled to said container opening, for selectively closing said container, said cap means including pivotable nozzle means for dispensing fluid from said container opening and for directing the flow of fluid dispensed from said container, said nozzle means having an opened position, wherein a tip portion of said nozzle means is directed away from said container opening and wherein said nozzle means is generally parallel to said longitudinal axis of said container, and a closed position, wherein said nozzle means was pivoted about a base portion such that said nozzle means is generally perpendicular to said longitudinal axis; and a generally hollow overcap member having interior and exterior surfaces, said overcap member adapted to be detachably engaged to said annular chime about said first end of said container and thereby substantially enclosing said cap means, said overcap member having a brush means disposed on at least a portion of the exterior surface of said overcap member, and having at least one aperture extending through said overcap member and located at said brush means, said overcap member being constructed and arranged such that said tip portion of said nozzle means extends into said aperture only when said nozzle means is in said opened position, whereby fluid from said container can be dispensed through said nozzle means into said brush means.

2. The fluid dispenser according to claim 1, wherein said aperture extending through said overcap member is centered within said brush means.

3. The fluid dispenser according to claim 1, wherein said container is a deformable plastic bottle.

4. The fluid dispenser according to claim 1, wherein said brush means is a bristle brush.

5. The fluid dispenser according to claim 1, wherein said tip portion of said nozzle means extends through said aperture and partially into said brush means when said nozzle means is in said opened position.

6. The fluid dispenser according to claim 1, wherein said overcap member completely encloses said cap means when said nozzle means is disposed in both the opened and closed positions.

* * * * *